US007845307B2

(12) United States Patent
Janssen

(10) Patent No.: US 7,845,307 B2
(45) Date of Patent: Dec. 7, 2010

(54) EFFICIENT AND FLEXIBLE MULTI SPRAY ELECTROSTATIC DEPOSITION SYSTEM

(76) Inventor: Wladimir Janssen, 395 Aberdare, Ville Mont-Royal, QC (CA) H3P 3J7

( * ) Notice: Subject to any disclaimer, the term of this patent is extended or adjusted under 35 U.S.C. 154(b) by 1048 days.

(21) Appl. No.: 10/599,571

(22) PCT Filed: Mar. 31, 2005

(86) PCT No.: PCT/CA2005/000485

§ 371 (c)(1),
(2), (4) Date: Oct. 2, 2006

(87) PCT Pub. No.: WO2005/095001

PCT Pub. Date: Oct. 13, 2005

(65) Prior Publication Data

US 2008/0067269 A1 Mar. 20, 2008

Related U.S. Application Data

(60) Provisional application No. 60/558,838, filed on Apr. 2, 2004.

(51) Int. Cl.
*B05C 5/02* (2006.01)

(52) U.S. Cl. ..... 118/621; 118/620; 118/695; 427/57

(58) Field of Classification Search ..... 118/620, 118/621, 695; 427/57
See application file for complete search history.

(56) References Cited

U.S. PATENT DOCUMENTS 2,097,233 A * 10/1937 Meston ..... 118/624
2,302,289 A 11/1942 Bramston-Cook et al.
2,509,277 A * 5/1950 Ransburg et al. ..... 118/671
2,685,536 A 8/1954 Starkey et al.
2,695,002 A * 11/1954 Miller ..... 118/626
2,706,964 A 4/1955 Ransburg et al.
3,020,579 A 2/1962 O'Connor
3,577,198 A 5/1971 Beam
3,775,806 A * 12/1973 Olbrant et al. ..... 15/309.1
3,930,614 A 1/1976 Krenkel
4,095,962 A 6/1978 Richards
4,749,125 A 6/1988 Escallon et al.

(Continued)

FOREIGN PATENT DOCUMENTS

EP 0051928 B1 1/1985

(Continued)

OTHER PUBLICATIONS

Joseph Crowley, Fundamentals of Applied Electrostatics, ISBN 0471803189, pp. 20, 229-239.

(Continued)

*Primary Examiner*—Parviz Hassanzadeh
*Assistant Examiner*—Albert Hilton
(74) *Attorney, Agent, or Firm*—Brooks Kushman P.C.

(57) ABSTRACT

An efficient electrostatic spray installation that can spray a wide range of conductive materials effectively while creating very small droplets with conductivities in from about 7000 pico Siemens and greater. A compact system in which one, two or more parallel sprays can be obtained at close proximity in the order of 30 to 40 mm of each other in a compact package.

25 Claims, 7 Drawing Sheets

U.S. PATENT DOCUMENTS

| | | | | | |
|---|---|---|---|---|---|
| 4,788,016 | A | | 11/1988 | Colclough et al. | |
| 4,790,155 | A | * | 12/1988 | Daniel et al. | 68/205 R |
| 4,801,086 | A | * | 1/1989 | Noakes | 239/3 |
| 4,814,788 | A | | 3/1989 | Davies | |
| 4,830,872 | A | | 5/1989 | Grenfell | |
| 5,209,410 | A | * | 5/1993 | Wichmann et al. | 239/696 |
| 5,306,412 | A | * | 4/1994 | Whitehouse et al. | 204/452 |
| 5,326,598 | A | * | 7/1994 | Seaver et al. | 427/473 |
| 5,332,154 | A | * | 7/1994 | Maier et al. | 239/3 |
| 5,441,204 | A | | 8/1995 | Tappel et al. | |
| 5,503,336 | A | | 4/1996 | Wichmann | |
| 5,516,354 | A | * | 5/1996 | Miller et al. | 75/338 |
| 5,628,463 | A | | 5/1997 | Nakamura | |
| 5,803,371 | A | * | 9/1998 | Sugiyama et al. | 239/555 |
| 5,980,919 | A | | 11/1999 | Greenfield et al. | |
| 6,158,235 | A | * | 12/2000 | Hawkins et al. | 62/399 |
| 2002/0168297 | A1 | * | 11/2002 | Shvets et al. | 422/100 |
| 2002/0175281 | A1 | * | 11/2002 | Valaskovic | 250/288 |

FOREIGN PATENT DOCUMENTS

| | | | |
|---|---|---|---|
| EP | 0123538 | B1 | 4/1988 |
| JP | 10100411 | A | 4/1998 |

OTHER PUBLICATIONS

Adrian Bailey, Electrostatic Spraying of Liquids, ISBN 0863800750, pp. 60, 61, 75-77.

* cited by examiner

EFFICIENT AND FLEXIBLE MULTI SPRAY ELECTROSTATIC DEPOSITION SYSTEM

CROSS-REFERENCE TO RELATED APPLICATION

This application claims the benefit of U.S. provisional application Ser. No. 60/558,838 filed Apr. 2, 2004.

TECHNICAL FIELD

The present invention relates to systems and devices for the electrostatic flow distribution and charging for spraying of flowable materials onto a target, wherein the systems and devices can be adapted for different flow rates and spray configurations, while maintaining flow control and fine mono disperse sprays, and methods of such systems and devices for spraying of flowable materials onto a target.

BACKGROUND ART

Electrostatics are used widely in industry, for instance it is used in solid state electronic devices, crop spraying, spinning of cotton, diagnostic equipment used in medical applications, paint spraying, smoke detectors, laser and inkjet printers, and many more different applications. A more complete overview can be found in Fundamentals of Applied Electrostatics, Joseph Crowley, ISBN 0471803189 (p. 229 to 239). Which reference is incorporated by reference in its entirety. There are well known electrostatic effects in nature such as lightning, and less known effects such as St Elmo's fire, a corona discharge from spars of a ship or from an airplane.

The deposition system in this invention is of the type whereby the atomization of a flowable material is principally obtained by charging it to a high electrostatic charge through direct contact with a conductive strip that is connected to a high voltage power supply.

The electrostatic field exerts a coulombic force on the surface of the flowable material and this is the dominant force for the dispersion process. In "hybrid systems" mechanical forces are used for dispersion whilst an applied electrostatic field, which can be by contact, induction or spraying through ionized air from a corona discharge, ensures that drops are charged.

The fluid dynamic processes are similar regardless of the type of force or forces used for dispersion. See for example Electrostatic Spraying of Liquids by Adrian Bailey, ISBN 0863800750, p. 60, which reference is incorporated by reference in its entirety, therefore the addition of other atomizing means will not be excluded from this invention.

Examples of applications of spraying using electrostatic principles are: coating of surfaces of solids or flexible webs of materials. (U.S. Pat. No. 2,685,536 Starkey et al, U.S. Pat. No. 2,706,964 Ransburg et al, U.S. Pat. No. 3,930,614 Krenkel, U.S. Pat. No. 2,302,289 Bramston-Cook, up to more recent patents such as U.S. Pat. No. 5,980,919 Greenfield et al).

Inkjet printing is another example in which electrostatic spraying is used. (for instance U.S. Pat. No. 4,814,788 Davies and U.S. Pat. No. 3,577,198 Beam). Other examples are in scrubbing (U.S. Pat. No. 4,095,962 Richards), or in chemical and physical processes such as producing powders and other granular materials (U.S. Pat. No. 4,788,016 Colclough et al). The examples are not exhaustive.

Because of the electrostatic principle of operation, no high pressures and atomizing nozzles are in principle necessary. However there are limitations to the materials that can be sprayed this way, as in most systems a fairly low conductivity is required for the flowable material. As an example, a preferable range of 20,000 to 100,000 pico Siemens is mentioned in U.S. Pat. No. 5,980,919 (Greenfield et al.)

By careful electrical insulation of the complete spray system, including the flowable material supply system, it is possible to extend the range of the conductivity limits for electrostatically spraying flowable materials.

Lower conductivity materials can be sprayed because higher voltages can be used than is possible with systems that are not as well insulated. Materials with higher conductivity can still be electrostatically charged when the complete flowable material supply system is electrically insulated. (U.S. Pat. No. 5,628,463 Nakamura)

In the patent literature, many electrostatic deposition systems have been described. In older systems, flowable materials were electrostatically charged in a plurality of points (U.S. Pat. No. 2,685,536 Starkey et all) but in later patents there is a slot, whereby the slot can be fed from a chamber or channel (U.S. Pat. No. 4,749,125, Escallon et al, and U.S. Pat. No. 4,830,872, Grenfell).

The slot may have an insert to ensure proper distribution of flow (U.S. Pat. No. 4,749,125, Escallon et all) and serrations at the slot's exit are mentioned in both the Escallon patent, in U.S. Pat. No. 4,788,016 (Colclough et al) as well as in U.S. Pat. Nos. 5,209,410 and 5,441,204 (Wichmann et al), to achieve a stable flow distribution by providing charge concentrating tips so that liquid is drawn out into ligaments at these tips.

Several patents mention means to achieve equal flow distribution over the length of a nozzle arrangement. In 2,706,964 (Ransberg et al), a combination of a rotating plug, timed pumps and moving flow directing elements is described, to distribute liquid progressively along a discharge member. In an earlier patent (2,695,002, Miller), a helical grooved rotating plug conveys liquid to successive points along a slot. In several patents (3,020,579 O'Connor, 5,209,410 Wichmann, et al, 5,441,204 Tappel et al, and 5,503,336 Wichmann), a hydrodynamic liquid distribution is described that distributes liquid from one inlet point to distinct dispensing points.

In U.S. Pat. Nos. 3,020,579 and 5,503,336, a binary type of distribution is described. In U.S. Pat. No. 5,209,410 triangular shaped chambers are used, while in U.S. Pat. No. 5,441,204 it is a network that systematically branches the fluid flow to a plurality of spaced distribution points.

In several patents, the geometry of the sharp edge where the electrostatic spray originates is described as this is seen as important for obtaining good results for different spray conditions (U.S. Pat. No. 4,814,788 Davies, U.S. Pat. No. 4,830,872 Grenfell, U.S. Pat. No. 5,503,336 Wichmann).

The concentration or increase of the charge in an electrostatic field by positioning an insulating material in front of a conducting electrode, is described in the literature. (Joseph Crowley, p 20.). In U.S. Pat. No. 4,830,872 (Grenfell) this effect is used and specific dimensions are given. (from 0.5 to 4 mm and 1 to 4 mm) for the distance of non-conductive material to the spray tip, in U.S. Pat. No. 4,788,016 (Colclough at all), a similar geometry is shown, but no specific dimensions are given.

In Adrian Bailey at p. 75, and in several patents (U.S. Pat. No. 4,830,872 Grenfell, U.S. Pat. No. 5,503,336 Wichmann), the good dispersion obtained by electrostatic spraying at low volume throughputs are mentioned, the two patents mention respectively 0.5 ml/cm of blade length per minute and 0.006 cc/min per inch of nozzle.

Ligament flow is an important concept and is sometimes mentioned as a factor that allows for even distribution of the flowable material as it atomizes and moves to the target area.

(U.S. Pat. No. 4,830,872 Grenfell, U.S. Pat. No. 4,814,788 Davies, U.S. Pat. No. 4,788,016 Colclough at all).

The finest and most mono disperse spray patterns are obtained when ligament flow is obtained. (Adrian Bailey, p. 61, 75, 76, 77).

The distances or wavelength between ligaments is quadratically and inversely related to the electrostatic field applied and is directly related to the surface tension of the flowable material.

The finest and most mono disperse droplet sizes are obtained in ligament flow with low flow rates, spraying flowable materials with a low surface tension, and by using high electrostatic fields. While it is possible to provide for a wide flow range of 0.006 cc/min per inch of nozzle to 30 cc/min per inch of nozzle (U.S. Pat. No. 5,503,336 Wichmann), it is not feasible to maintain the same droplet size through out this range, with only one nozzle arrangement, unless more ligaments are created as the flow is increased. This would imply increasing the electrostatic field with increased flow.

For this reason, depending on the requirements for droplet size and spray quality, parallel nozzle arrangements are needed to satisfy the requirement for a small droplet size and therefore good dispersion and spray quality, at increasing flow rates.

An example of a double spray assembly is shown in FIG. 3 of U.S. Pat. No. 5,209,410 (Wichmann et al).

The current invention provides a number of novel features. It is an object to provide an electrostatically efficient and compact system with multiple spray heads in a relative small space. It is a further object to provide such a system which can be easily adapted for different flow rates and spray configurations, while maintaining good control and giving fine mono disperse sprays. It is a further object to provide ligament flow with very small distances between the ligaments promoted by the geometry and design, and the capability to create high electrostatic fields. The spray system can be used for the deposition of flowable materials on to a substrate or a surface, or in other applications such as mentioned in the literature. Even distribution over the length of a spray, or of several parallel sprays, is enhanced by supplying sections of the spray length with precisely controlled flows.

As a further object, the conductivity range of the flowable materials that can be sprayed is much wider than of any similar equipment as mentioned in the literature because of a design that uses an absolute minimum of conductive parts, in addition to a flowable material supply system that is electrically insulated. With the paths to ground minimized, less electrical power is needed. In practise this means that several parallel sprays can be powered by one high voltage power supply, and lower currents ensure that higher voltages can be maintained, for obtaining finer droplets in the sprays.

The spray system is designed such as to provide substantial dripless start and stop of the spray or sprays. The system can be heated to provide for spraying of higher melting point materials or to lower the viscosity of the flowable material that is sprayed.

The quality of the spray can be monitored by a vision system consisting of one or more cameras connected to a processor that is capable to observe the number of ligaments and their distribution, as the start of the ligaments show up as distinct points under illumination.

DISCLOSURE OF THE INVENTION

The invention comprises a novel design and system to deposit flowable materials on a substrate by electrostatic means. Some specific applications and general material formulations that have been used advantageously are also included.

A double nozzle arrangement which sprays in down ward direction, is described first. This arrangement consists of a vertical member and a horizontal member that is bolted to the vertical member, and that are both of a plastic material that is a good electrical insulator. A preferred material is acetal, of which the commercial name is 'Delrin'. Other materials can be employed if necessary for special reasons, for instance for good dimensional stability at high temperatures, a ceramic material may be preferable.

The bolts are cap screws of an insulating material, such as fibreglass or when more strength is desired, they can be made of a fibreglass with a high content of glass fibres.

To both sides of the vertical member, a stainless steel shim material is attached, and kept in place by small diameter stainless steel bolts at either end. A suitable adhesive can be used in addition if the nozzle assembly is very long.

Alternatively, the areas where the stainless steel shim material is shown, can be made conductive, for instance by deposition of a metal film or by other means used to make non-conductive materials locally conductive. Or the stainless steel shims can be recessed in the vertical member. For these cases, a permanent 'lip' can be provided, for the ligaments to originate on the nozzle assembly, or this can be a recess to receive a flexible lip similar to the previously described design.

One of the small stainless steel bolts, on one side is connected to the high voltage power supply through a hole through both the vertical and horizontal member. A resistor with small springs on each side can be situated in this position as part of the safety system of the high voltage power supply that is to prevent the possibility of arcing.

The small bolt on the other side is either used for a special switch, or it is used to carry the high voltage to a next spray assembly or to an optional dust collecting bar.

In these cases, the switch will be located at the end of the high voltage chain.

The special switch is employed as a means to quickly remove the voltage of the conductive strip or shim.

The horizontal member can be equipped with a number of threaded holes on the sides, to accept a clamp arrangement that holds the flow distribution modules in place. The clamp arrangement is made of the same plastic material ('Delrin') and the bolts are fibre glass as mentioned before. Alternative clamp arrangements are possible, but not shown here.

The length of the assembly can be made as long as required by staggering the vertical and horizontal members. For typical dimensions, this structure can span lengths of 2 meter and more with support on either end, and more if additional support is provided along the length. For this additional support the clamp holes in the horizontal member can be used.

On both sides of the vertical member, below and optionally above the stainless steel shim material, are strips made from plastic sheet, which can be 'Delrin' or another insulating plastic material. This plastic sheet has the same thickness as the stainless steel shim material. Alternatively, the stainless steel shim can be recessed in the plastic material as mentioned earlier.

More flexibility is obtained by having a strip of Delrin material, then a strip of conductive shim material, and then again a strip of plastic material, as all three strips can easily be changed to accommodate a specific spray set up.

Alternatively, the three strips can be one strip of non conductive substrate, of which a band has been made conductive, this band is for instance metalized or made conductive in some other way.

Flow distribution modules are kept in place on both sides of the vertical member by fibre glass bolts that are threaded through the vertical parts of the clamp.

The above description is for a flow assembly that sprays downward. This is preferred, but it is possible to spray straight up or to spray at any angle in between.

It is advantageous to spray downwards and have gravity as a positive force, but in some applications spraying upwards is the only practical option.

The bottom plastic strip projects underneath the vertical member and forms what can be called a lip. The top plastic strip is a filling piece to provide a flat and continuous surface for the flow distribution modules.

The distance that the lip projects beyond the flow distribution module provides length for the flow paths to develop ligament flow and a thin, sharp pointed line from where the ligaments leave and subsequently break up to become a spray. The dimensions of the lip, thickness and width, can be easily changed to provide a different geometry. The same is true for the stainless steel shim material.

The dimensions of the stainless steel shim material and the plastic strips can be chosen so as to obtain the best spray results. The best spray results are obtained by keeping the shim material thin and extending it to about 3 mm from the bottom end of the vertical member, after which it is extended by a strip of the same thickness of Delrin or other electrically insulating material, for another 8 to 15 mm, so that it projects 5 to 12 mm under the bottom of the vertical member.

The flow distribution modules for the configuration for one spray or two parallel sprays, are equipped with grooves on one surface. The conductive strip on the vertical member is located opposite the grooves for at least a portion of the length of the grooves.

Optionally, the stainless steel shim material can be up to the horizontal member of the assembly to simplify the sealing of the flow distribution module.

Alternatively, the shim material can be set back in the vertical member, and a lip can be machined in the vertical member. This would be a configuration that is less flexible, but minimizes the number of parts.

Thus, the present application relates to an electrostatic flow distribution and charging system for spraying flowable materials by distribution and charging to a suitable high voltage, after which the sprayed materials are dispersed mainly by internal electrostatic force while moving to a target that is at a different voltage.

For practical reasons the target is typically grounded or at zero voltage, and the flowable material can be charged with a negative or a positive voltage.

A substrate can be sprayed by placing it in front of the target, or the substrate can be the target if it is a suitable conductive material, for instance steel sheet, metal trays etc.

The nozzle assembly is substantially built from an electrically insulating material, for example from a common polymer material such as "Delrin". It consists of typically one center piece which has a thin strip or band of electrically conductive material on the surface at each side. The electrically conductive material is typically a thin stainless steel foil or it can consist of an even thinner film of metal that is deposited on the insulating material, or the insulating material it self has been made conductive locally in a band or strip on the surface.

It is possible to create one, two or more than parallel sprays in one assembly, which is not possible with the systems described in the literature. A finer spray can be created when a given flow is distributed over more than one spray.

A stacked spray assembly with more than two parallel sprays is possible but has the disadvantage that the inner flow distribution modules may be difficult to observe, when the length of the spray is larger. With a double spray, the flow distribution modules are accessible and can be removed individually for servicing, cleaning, or replacement to obtain different spray patterns, or to accommodate different materials, flow rates or flow distributions.

Flow distribution modules are kept in place on both sides of a central member.

This can be done, for example, via a cantilever construction connected to the central member and bolts that can be tightened as required, or alternatively by a Cclamp or similar type of arrangement. The cantilever arrangement or C-clamps can be positioned to accommodate the flow distribution modules that are being used.

All materials used in this assembly are electrical insulators. The only parts that are electrically conductive are the conductive surface and the electrical connections to this surface. This ensures efficient transfer of electric charge to the material that is sprayed with minimum loss from electrical currents through the assembly, so little electrical power is needed to obtain effective spraying in a wide range of conditions, at the same time needing a minimum of electrical power The conductive surface in the assembly is connected to a high voltage power supply.

Typically the currents are in the micro amp range while the voltages applied are from 20 kV to 150 kV and higher. The upper limit is in practise determined by the capability of the power supply, and the cables and connections used to take the high voltage to the charging strip. The theoretical upper limit is when the electrostatic field strength becomes strong enough for a corona discharge. In air this can occur at a value of approximately 3 million Volt/meter.

The flow of material is distributed and guided through grooves in the non-conductive flow distribution flow modules and over the electrically conductive part of the assembly substantially parallel with the electrostatic field.

The directional electrostatic fields created by the charged parts of the center piece in the assembly together with the target or targets that are shaped such as to attract each charged spray, provide a positive force that tends to equalize the flow of material through the flow distribution modules. Each groove in the flow distribution modules is aligned with the direction of the electrostatic field and the application of the electrostatic field provides a positive force or pressure to move the material that is sprayed through the grooves. Because of this, the flow through each groove in a flow distribution module over the width of each module becomes substantially equal. For this reason it is not necessary to provide for a special geometry of channels to hydrodynamically distribute the flowable material to be sprayed over the length of a distribution module. The driving force provided by the electrostatic field augments that of the supply pressure or static pressure head and increases with the voltage difference that is applied between the charging strip or strips and the target bar or bars. The geometry of the distribution module and the dimensions of the grooves, the contact provided with the flowable material, and the flowable material properties such as viscosity and electrical conductivity, further determine the flow distribution.

In order to optimize a precise distribution over a series of flow distribution modules and generate a substantial constant spray over a given length, each or several flow distribution modules are supplied by a separate supply of flow that is individually controlled or supplied. One way to ensure a precise equal flow for each flow distribution module is to use a commonly driven stacked assembly of precise metering pumps, whereby each metering pump is supplying a flow distribution module. But individual metering pumps can also be used, in any combination as is required. One stacked metering pump could supply one spray and a second stacked metering pump the next parallel spray, so two different materials could be sprayed, so on a moving web the first spray would be covered by the second spray. Using individual metering pumps and supply reservoirs, each flow distribution module could spray a different material.

The multi spray electrostatic deposition system incorporates a substantial dripless start and stop of the spray. A dripless start is obtained by establishing the electrostatic field before starting the flow to the flow distribution modules. A dripless stop of the spray is provided by the combination of a special switch to eliminate the high voltage differential between the charging strip and target bar quickly and by having a geometry so that the supply of the sprayable material can be removed from the entrance to the parallel grooves in the distribution modules, by temporarily 'suck back'. Without a switch to eliminate the voltage differential, the electrostatic field will decay slowly, and flowable material will continue to spray even though the supply of flowable material has been stopped.

The momentary reversion of flow can be provided by an active expansion chamber or by temporarily reversing the direction of the pumping action.

The construction of a multi spray assembly provides great flexibility in the widths and shapes that can be made, in flow rates per length of the spray, in materials that can be sprayed etc. Gapped or interrupted spray patterns can be provided or curved spray patterns to accommodate the shapes of substrates to be sprayed, are possible as well.

A gapped spray is facilitated not only by the width of a flow distribution module but also by providing target bars that are separate from the normally used catch trays and the like, and that are shaped to define the gapped spray pattern.

DETAILED DESCRIPTION OF THE DRAWINGS AND OF THE PREFERRED EMBODIMENT

Figure 1:
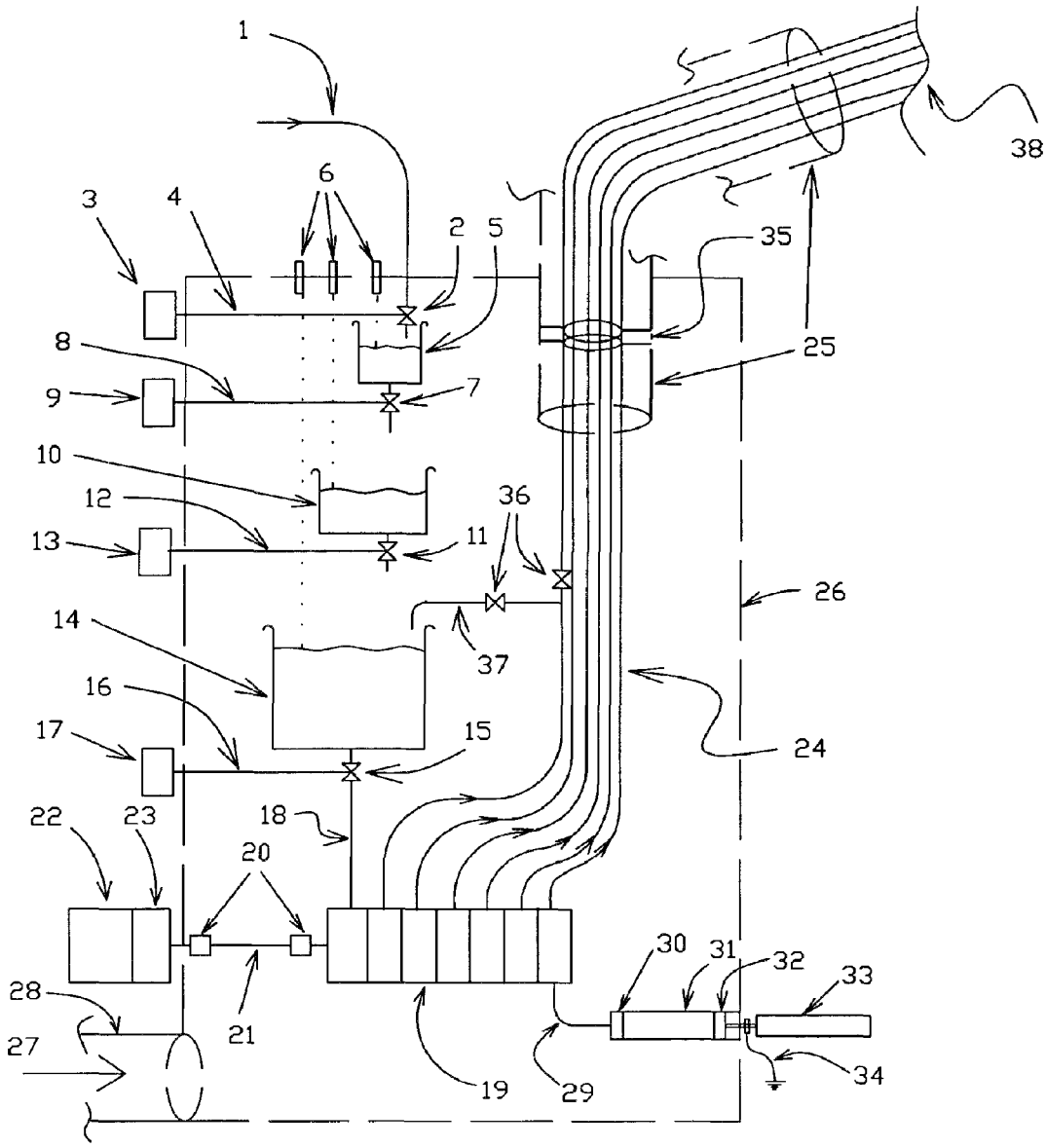
FIG. 1 is a drawing of the principle elements of the flowable material handling and supply system.

In FIG. 1, flowable material is pumped via line 1 and valve 2 into reservoir 5.

Valve 2, shown to be open in the FIG. 1, is operated by actuator 3, through a rod 4. The level in reservoir 5 is measured by one of the remote level transducers 6.

The transducers 6 are level transmitters that operate by ultra sound, radar, infrared or other light etc, and that measure at some distance without contact to the materials that are being measured.

At the outlet of reservoir 5 is a valve 7, shown closed in FIG. 1, operated by actuator 9, through rod 8.

Reservoir 10 is electrically insulated and is filled with flowable material from tank 5 by the opening of valve 7

Reservoir 10 has a valve 11 that is operated through rod 12 by actuator 13.

As reservoir 10 is electrically insulated, rod 12 is made from an electric insulator such as Delrin.

Reservoir 10 can either be filled, or it can discharge and fill reservoir 14 through valve 11, rod 12 and actuator 13. But both operations can not occur at the same time.

Reservoir 10 functions as an electrical barrier between reservoir 14 and reservoir 5.

Reservoir 14 feeds pump 19 through line 18 and valve 15. Valve 15, shown open in FIG. 1, is operated through an insulating rod 16 by actuator 17.

Line 18 can be provided with filter arrangements, but these are not shown to simplify FIG. 1.

Also not shown are agitators that may be needed in each of the reservoirs.

If agitators are added, provisions need to be made to electrically insulate these for reservoirs 10 and 14. This can be done for instance by using agitators equipped with air motors.

Pump 19 is a multi outlet gear pump that is driven by motor 22, through gearbox 23, flexible couplings 20, and floating shaft 21. Shaft 21 is made from an insulating material.

Motor 22 is a servo or a stepping motor which can be controlled to give precise rotational speed.

The outlets of pump 19, six are shown but more or less are possible, are connected by flexible tubing 24 made of an electrical insulating material. Each tube is led through conduit 25 that is made from an electrical insulating material.

The tubing 24 are kept located in the conduit 25 by spacers 35 (one shown only), which locate the tubing but do not obstruction for flow of a gas such as air. Spacers 35 are also made from an electrically insulating material.

The reservoirs, lines, valves and pump are all mounted in an enclosure 26 that can be supplied with a hot gas, such as hot air as indicated by arrow 27, through conduit 28.

The hot gas serves to keep all parts in contact with the flowable material warm for these cases where this is required, for instance when spraying a flowable material with a melting point that is higher than normal ambient temperatures.

Line 37 and valves 36 are shown in one of lines 24 to indicate the possibility to stop one or more of the flows through lines 24, if so required, and recirculate one or more flows through reservoir 14. This can be necessary if different spray widths are required.

Line 29 is an insulated electrically conductive wire that connects the pump, normally made of stainless steel or similar material, to the contact 30 in tube 31. Tube 31 is made of an electrical insulator.

Actuator 33 can move contact 32 to touch contact 30, to electrically ground pump 19 when this is required, through the ground wire 34.

This system provides for heating of the flowable material as well as complete electrical insulation of the flow handling system.

The electrical insulation is a requirement for spraying higher conductivity materials, as otherwise the high voltage would be lost through the flowable material supply system.

Using lower conductivity materials, this system does not provide a path to ground and therefore there is less demand on the electrical power supply to maintain the voltage high.

The pump will however accumulate charge and grounding will be needed for safety reasons when the pump or reservoir 14 needs to be accessed by personnel.

Figure 2:
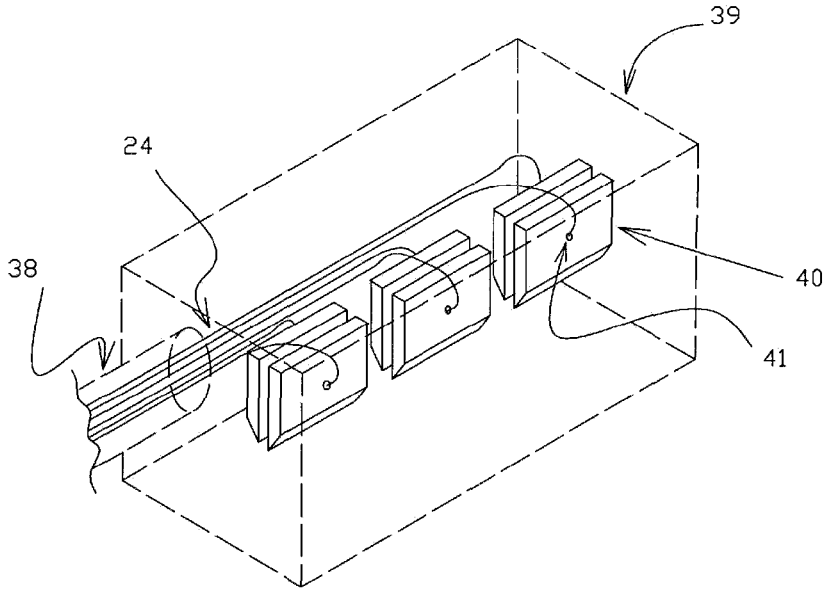
FIG. 2 is the continuation of FIG. 1 showing the individual supply lines to each of six flow distribution modules of the example. For clarity, the flow distribution modules are shown without support in a configuration of two parallel rows of three modules each.

FIG. 2 shows the continuation of lines 24 in conduit 38 into enclosure 39.

The hot gas or air that is blown through conduit 38 warms the six flow distribution modules 40 that are shown schematically and without support in this isometric view.

Tubes 24 are connected to the flow distribution modules by the use of fittings 41, which are made of an electrical insulating material such as Delrin, Kynar or the like.

Figure 3:
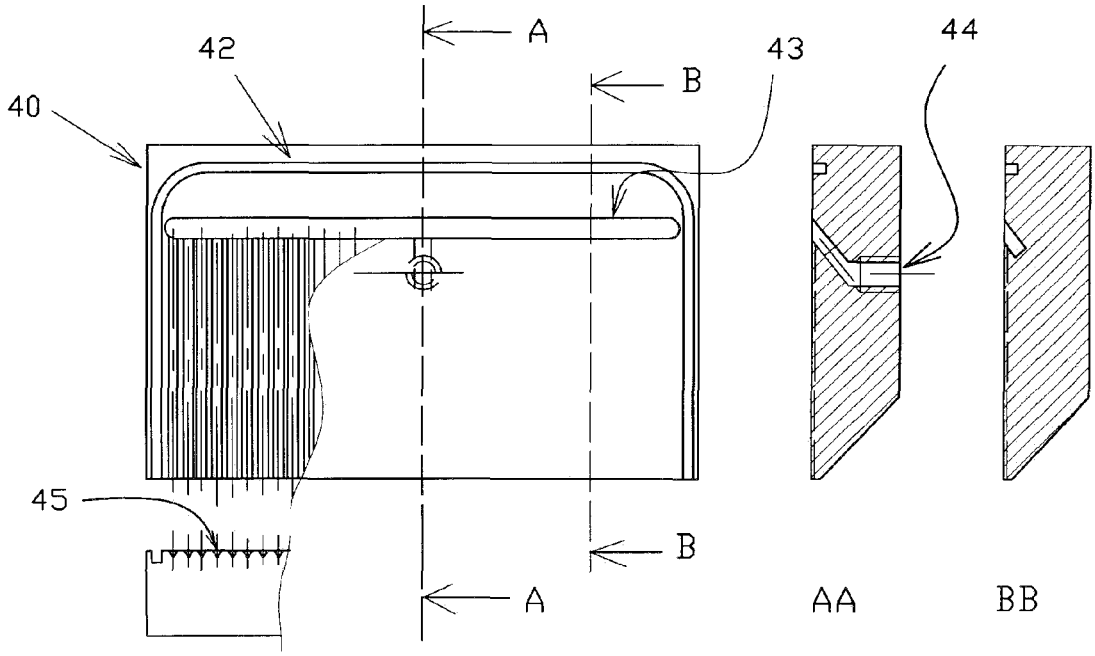
FIG. 3 shows a typical flow distribution module with the inlet connection, a distribution channel and grooves.

FIG. 3 shows a flow distribution module 40, with threaded inlet 44. The module is made from an electrically insulating material. Inlet 44 is connected to distribution groove 43 which distributes the flowable material over the width of the module. As this is a module for spraying downwards, the inlet is located below the level of the distribution groove 43. For upwards spraying this would be the other way around.

An O-ring groove 42 assembled with an O-ring, provides a seal to the vertical member in the assembly.

Grooves 45 provide a path for the flowable liquid in the direction of the electrostatic field. Opposite grooves 45 his a conductive charging strip. The grooves 45 are shown only in the left hand portion of the face of the flow distribution module, but of course occupy the full area between the O-ring grooves 42. The shape of the grooves 45 can be triangular, rounded, rectangular or a combination of these shapes. A triangular shape is shown in FIG. 3.

Figure 4:
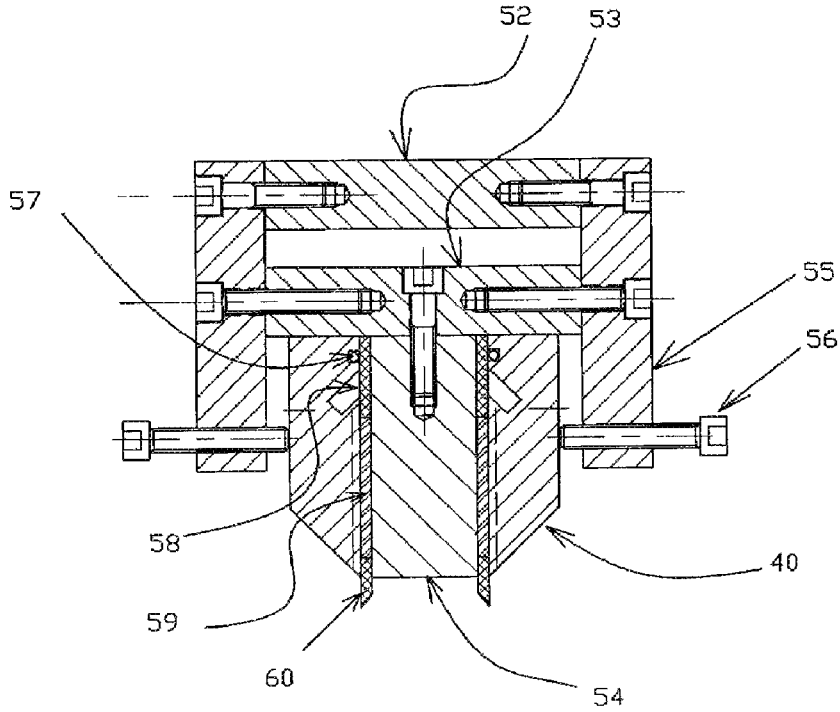
FIG. 4 Shows a double spray assembly in cross section with a clamping arrangement, and the details of the principle parts.

In FIG. 4, the flow distribution modules 40 are shown assembled with member 54 and charging strips 59. Nonconductive foil or sheet 58 is placed above the conductive strip 59, and non-conductive foil or sheet 60 is placed below the module. The last can be sharpened to a point as this helps to concentrate the electrical field and more ligaments can be formed. Or it can be very thin and is therefore sharp by itself.

O-ring 57 provides a seal with vertical member 54.

Member 53 is bolted to vertical member 54. All bolts shown are made from a non-conductive material. (fibre reinforced glass or the like).

Horizontal members 52 and vertical parts form a clamp arrangement 55.

This clamp arrangement can be positioned in various positions along the length of the spray assembly to accommodate the dimensions of flow distribution modules 40.

Bolts 56 exert a force on flow distribution modules 40 that keep these modules in place.

Figure 5:
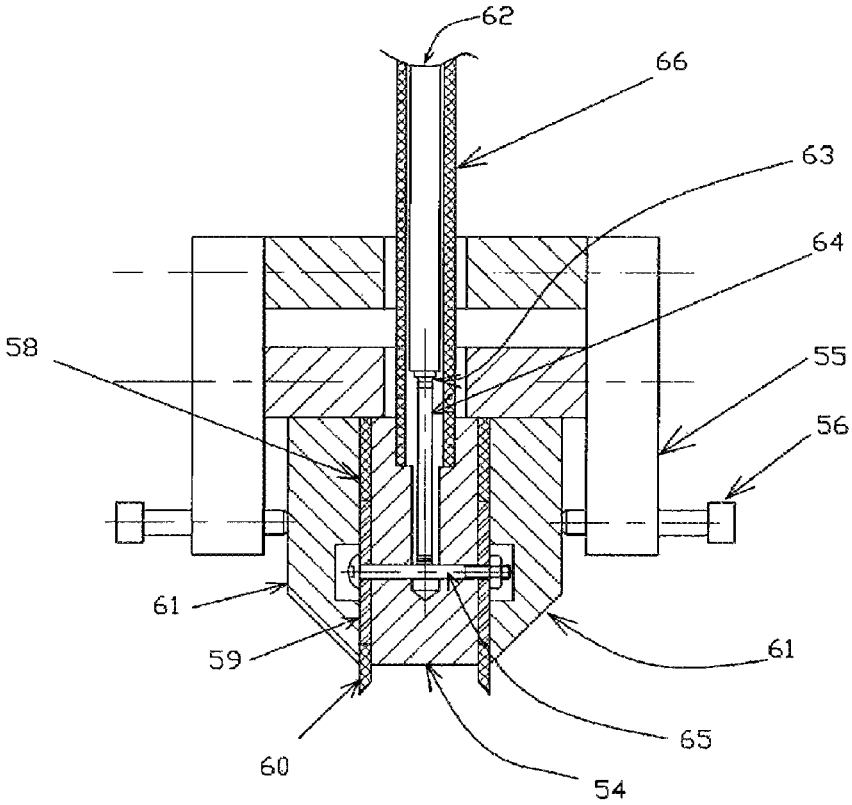
FIG. 5 shows the connection of the high voltage cable to the charging conductive parts in a double spray assembly, with the end caps that cover the high voltage parts et each end of a spray assembly.

FIG. 5 shows the arrangement at the end of a spray assembly where a high voltage cable provides the high voltage to the charging strips 59. Cable 62 is led through tube 66 made from an electrical insulator. The contact 63 at the end of the cable pushes against resistor 64 which in turn contacts through-bolt 65. The throughbolt 65 holds charging strips 59 in place. It is typically made from stainless steel and is the only electrical conductor used in the assembly apart from the charging strip 59.

A clamp arrangement 55 is used as for the flow distribution modules to keep two end caps 61 in place using bolts 56. End caps 61 are provided with a depression to accommodate the head and nut of the through bolt. End caps 61 do not have Oring grooves. The nonconductive foil or insulator 58 goes around the conductive strip 59 at both ends of the spray assembly on member 54, thereby insulating conductive strips 59 at either end of the assembly.

Figure 6:
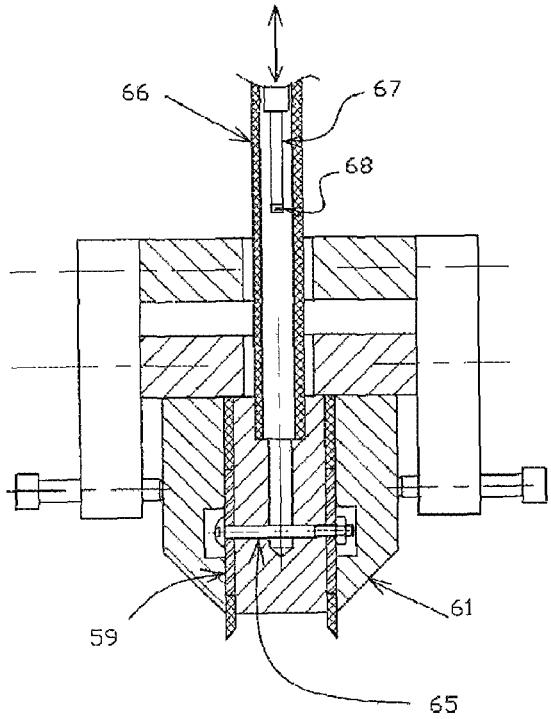
FIG. 6 shows a ground switch arrangement that can be used at the end of a spray assembly or at the end of a chain of several such assemblies.

FIG. 6 shows a ground switch that is used to remove the high voltage from the charging strips when the electrostatic spray is stopped. Plastic non conducting rod 67 is equipped with a contact 68 to a wire (not shown) that is connected to ground. Pipe 66 is made of a non conducting plastic material and guides rod 67.

Grounding of the charging strips 59 is accomplished by moving rod 67 down and touch through-bolt 65 with contact 68.

Figure 7:
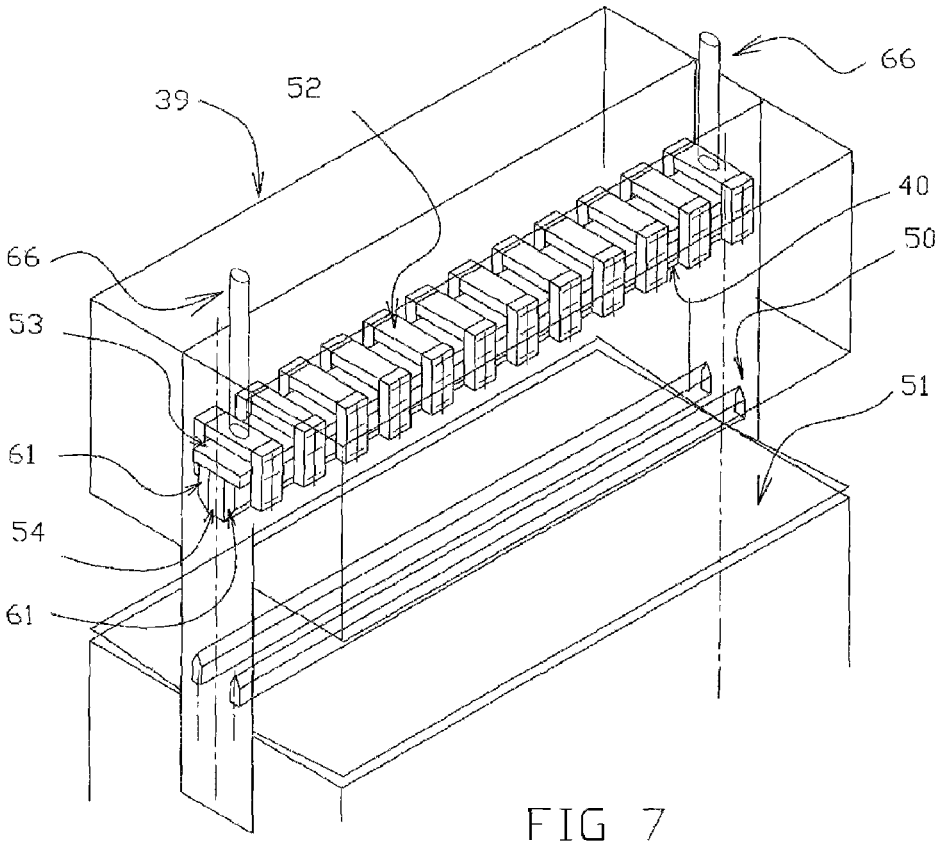
FIG. 7 is a principle sketch of a double spray assembly with an enclosure, high voltage connections, or one connection and one ground switch. The target bars and catch tray arrangement is also shown.

FIG. 7 shows an assembly with multiple flow distribution modules 40 and clamps 52, in an enclosure 39. Tubes or pipes 66 are shown at either end of the assembly for the high voltage connections and or a ground switch.

The electrostatic field of each spray is directed to the target bars 50 that are located above a drip pan 51. The drip pan 51 can be given any convenient shape to conveniently collect flowable material, as it is separate and located further away from the charging strips than are the target bars 50. Further indicated are flow distribution modules 40, vertical member 54, and horizontal member 53.

Figure 8:
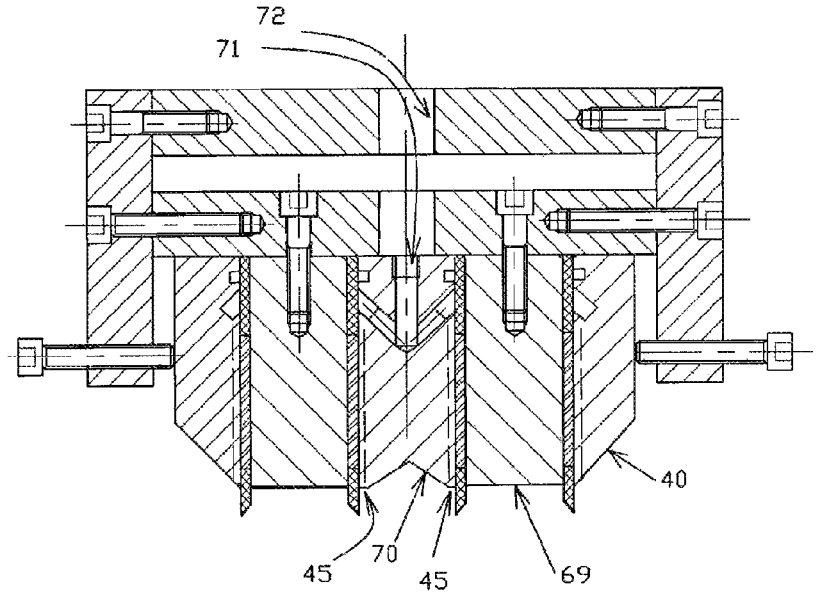
FIG. 8 shows a compact spray assembly with four parallel sprays.

FIG. 8 shows an arrangement with four parallel sprays. There are two vertical members 69 in this assembly. Each of the vertical members has a charging strip arrangement on both sides, as previously described. The flow distribution modules 40 that are located on the outside are the same as described earlier. Flow distribution modules 70 are special for this multi spray assembly as they have grooves 56 at both sides. Furthermore these modules are supplied with flowable material from using threaded hole 71 and clearance holes 72. In this sandwich construction, vertical members 69 are either precisely positioned, or they are allowed to be movable to some degree, so that the clamp arrangement will achieve proper sealing for all the flow distribution modules.

EXAMPLES

The following examples are presented as illustrative of some aspects of the present invention and should not be construed so as to limit the scope of the present invention.

Figure 9:
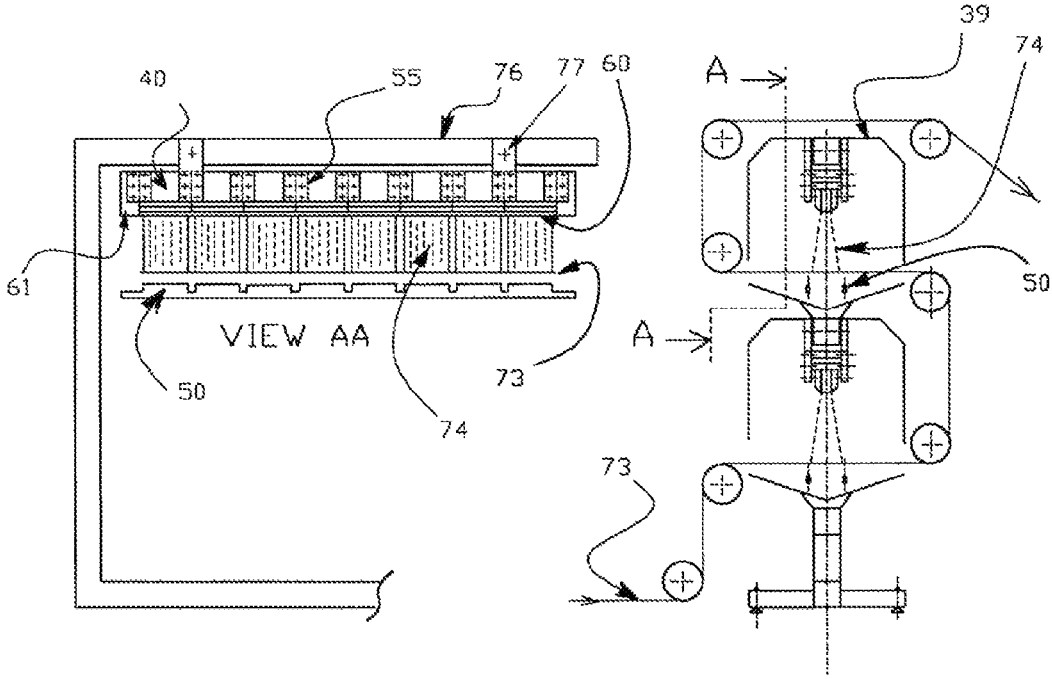
FIG. 9 shows the application of two double spray arrangements for the application of lotion to both sides of a tissue paper web in eight distinct lanes.

FIG. 9 shows an application whereby a tissue paper web 73 is sprayed with a high melting point lotion on both sides of the web.

The paper tissue substrate is sprayed using a gapped spray 74 which is obtained by having grooves in the equivalent areas of the flow distribution modules, and by having the target bars 50 shaped with raised parts to attract and direct the spray where it is required.

The lotion and the spraying equipment is kept at a temperature of 45 degrees Celsius, by blowing hot air under the enclosures 39. The lotion contains mineral oil, waxes to raise the melting point, as well as a conductivity agent, besides other ingredients. The last can be ingredients that are beneficial to the human skin and ingredients that enhance the feel of the tissue paper.

The spray is gapped and the unsprayed areas is where the multiply tissue paper is subsequently bonded together by mechanical means. The ply bonding of multiply tissue paper is more difficult when lotion is applied, so it is an advantage not to apply lotion in these areas, besides reducing cost.

Figure 10:
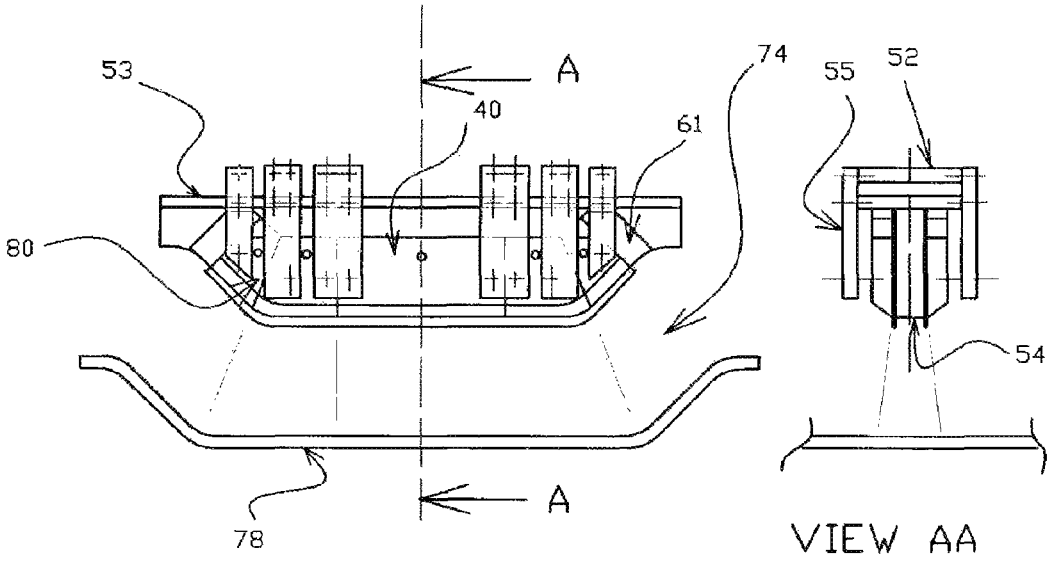
FIG. 10 shows the application of a shaped spray for spraying cooking oil on to a cooking tray.

FIG. 10 shows the spraying of a shaped baking tray 78 with cooking oil. The tray 78 is made of metal and forms the grounded target for the cooking oil spray. Vertical member 54 is shaped to follow the contour of the baking tray. The spray distribution module ends 80 on both sides of spray distribution module 40 are angled on one side to accommodate the contour to be sprayed.

End caps 61 are cut away to fit under horizontal member 53.

Figure 11:
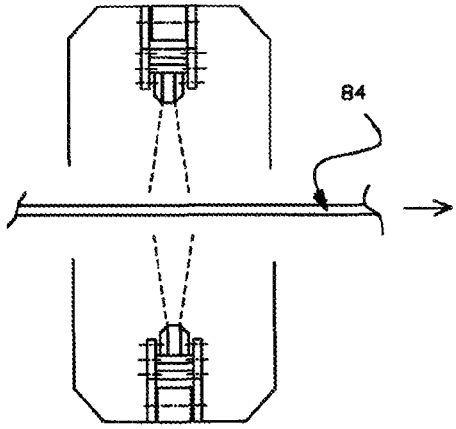
FIG. 11 shows the spray assembly for spraying steel plate with a protective or lubricating oil on both sides.

FIG. 11 shows the coating of a steel sheet 84 with oil for lubrication and corrosion protection.

This is a traditional application for electrostatic spraying. One assembly is for spraying upwards and one is for spraying downwards on to the steel sheet 84, which is also the grounded target for each spray. In this application, typically low add on rates are required, so one spray in each assembly will be used at the time and the other parallel spray will be kept on stand by.

Figure 12:
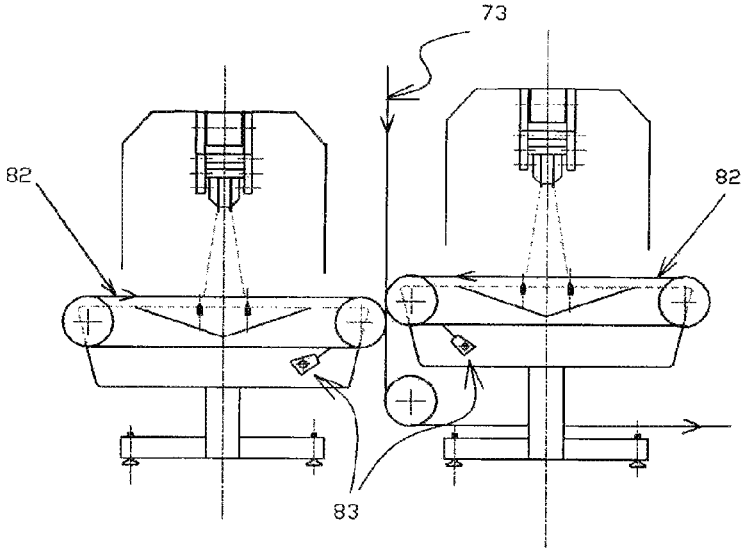
FIG. 12 shows two double spray assemblies that spray on an applicator belt which transfer the sprayed material to a vertical paper web, to coat this web.

FIG. 12 shows the spraying of an applicator belt 82 which in turn applies flowable material to a vertical web. The advantage of using an applicator belt or roll is that the electrostatic spray application is separated from the application to the substrate. This may in some cases be desirable, for instance if coating by contact is preferred over direct spraying. In this case the spraying can be vertically downward and the web to be coated can be running vertically down as well. Doctor blades 83 are provided to clean the applicator belt from any material that may be dislodged from web 73.

The left hand assembly is positioned slightly lower so that the web is forced to change direction slightly and gentle contact is provided with both applicator belts 82.

Figure 13:
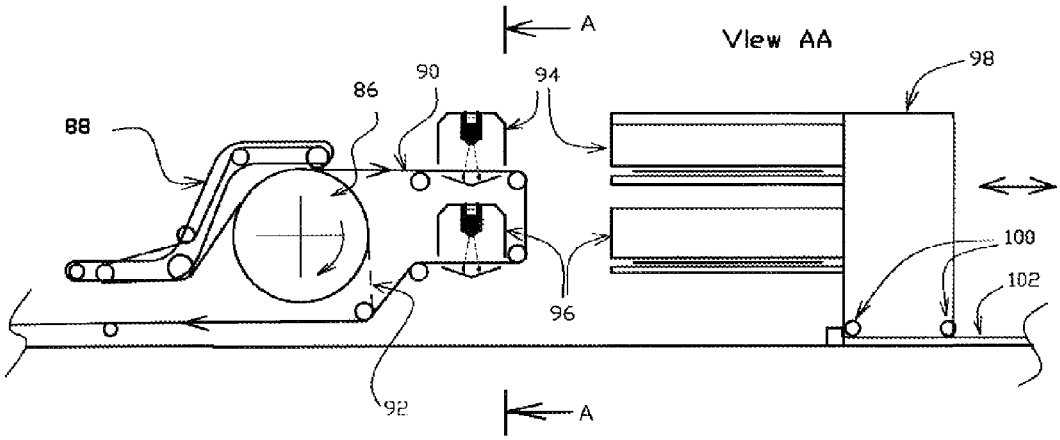
FIG. 13 shows a backstand with a belt driven parent roll of a flat wound product with two double spray assemblies that apply a spray to the two sides of the web.

FIG. 13 shows two electrostatic sprays in a cantilevered arrangement. The spray arrangement is positioned directly behind a parent roll 86 that is surface driven by a drive belt arrangement 88. The web 90 passes through spray assembly 94 and is sprayed on one side, then it passes through spray assembly 96 and is sprayed on the other side. A web path as indicated by dotted line 92 can be used in case no spray treatment is required.

The cantilever spray arrangement 98 is mounted on rollers 100 and can be moved over rails 102. The web 90 can be threaded with the cantilever spray arrangement in retracted position. Once threaded, the spray arrangement 98 can be positioned over web 90.

The skilled person will appreciate that numerous modifications and variations of the present invention are possible, having regard to the above description and that the scope of the present invention should be understood in terms of the claims as follows and not limited to any specific detail of structure or operation as described or shown in the present specification or drawings.

The invention claimed is:

1. An electrostatic spray system installation comprising: a vertical member having an elongate length and a transverse width and forming two outside surfaces along opposing sides of the length, the vertical member being positioned above a conveyed substrate such that the transverse width is aligned with an axis of travel of the substrate;

parallel flow distribution modules made from non conductive materials that are coupled to the vertical member, the parallel flow distribution modules are positioned adjacent to the two outside surfaces of the vertical member for providing continuous parallel sprays;

a conductive surface including a pair of charging strips, each strip being mounted to one of the two outside surfaces of the vertical member and facing a flow distribution module and maintained at a voltage of a minimum of 20,000 volts, wherein each of the flow distribution modules is supplied by a controlled flow of a flowable material, and wherein the flow distribution modules can be given different dimensions and can be positioned to give various spray configurations;

one or more target bars formed with a length oriented parallel to and spaced from the vertical member with the substrate conveyed therebetween each target bar being maintained at a different electrical potential from that of the charging strips thereby defining one or more electrostatic fields, in which each target bar is separate from a catch tray and formed with a height having high parts and low parts, the high parts being spaced along the length to create distinctive electrical fields for providing continuous parallel sprays onto the substrate by attracting the spray towards the high parts and away from the low parts; and grooves in the non-conductive flow distribution flow modules, said grooves disposed over the conductive surface and said grooves being parallel with the electrostatic field and are distributed over the width of the flow distribution modules.

2. An electrostatic spray system as claimed in claim 1 wherein several rows of parallel flow distribution modules are positioned in between parallel members, and in which flow distribution modules can in addition be positioned on the outside surfaces of the members.

3. A system as claimed in claim 1 wherein a number of flow distribution modules are assembled to obtain a required spray length, in which different flowable materials are submitted to the flow distribution modules, in which the flow distribution modules have different dimensions, in which different flow rates are used for one or more flow distribution modules.

4. A system as claimed in claim 1 wherein the electrostatic field follows a contour in a curved plane, by shaping the main vertical member and flow distribution modules and by having a similar contour in the target bars.

5. A system as claimed in claim 1, comprising means for electrically insulating a flowable material supply system, and that supplies the flow distribution modules with controlled flows of flowable material having conductivities greater than 7,000 pico Siemens.

6. A system as claimed in claim 5 wherein the flowable material supply system is heated by a hot gas or liquid.

7. A system as claimed in claim 1 wherein the members and flow distribution modules are heated by a hot gas or liquid.

8. A system as claimed in claim 1 wherein each charging strip includes solid thin conductive charge imparting parts covered by flow distribution modules.

9. A system as claimed in claim 8 further comprising a drip proof stop of a spray action obtained by the control of the flow to the flow distribution modules in two directions, to provide temporary reverse suction of flow.

10. A system as claimed in claim 9 further comprising a ground switch; wherein the drip proof stop of the spray is obtained by combining temporary suction of the flow to a flow distribution module with the quick removal of the high voltage from the charging strip by means of the ground switch.

11. A system as claimed in claim 10 wherein the system is configured for downward spraying and the drip proof stop is further facilitated by the location of the inlet of each distribution module below the feed line of the grooves that are aligned with the electrostatic field, ensuring the minimum of flowable material to be available for dripping.

12. A system as claimed in claim 1 wherein a precise stacked metering pump, driven by a precisely controlled motor, supplies a number of flow distribution modules over the length of a spray assembly.

13. A system as claimed in claim 12 further comprising outlet lines connected to the precise stacked metering pump, the output lines are provided with valves so that individual flow distribution modules can be supplied with flowable material or be disconnected from the supply, by diverting the flow from the outlet lines back to the feed tank.

14. A system as claimed in claim 1 wherein the flowable material is sprayed on a belt or roll which and subsequently transfers this material to a web of material to be coated with the flowable material.

15. A system as claimed in claim 1 wherein the flowable material is sprayed on a web, the web comprises two sides and the two sides of the web are coated by using two spray assemblies which spray downwards and through which the web is guided by rollers in an S configuration.

16. A system as claimed in claim 15 wherein the two sides of the web are coated by using two spray assemblies which spray downwards and through which the web is guided by rollers in an C configuration.

17. A system as claimed in claim 1 wherein the flowable material is heated when being sprayed, but then subsequently cooled with a cold gas such as cold air to provide a lower temperature of the flowable material when it reaches the target.

18. A system as claimed in claim 1 wherein the spray system with flow distribution modules is illuminated in the area on the lips where ligament flow occurs during spraying, and a vision system is used to count the ligaments.

19. A system as claimed in claim 1 wherein grounding switches are provided as a means to remove the high voltage quickly from the charged parts.

20. A system as claimed in claim 1 wherein said system is automated and controlled by a computer system.

21. A system as claimed in claim 1 wherein said system is preceded by a dust removal device such as a web cleaner, or a separate electrostatic device for dust removal.

22. A system as claimed in claim 1 wherein atomization by a gas such as air is incorporated.

23. A system as claimed in claim 1 wherein mechanical energy is used to affect the spray characteristics.

24. An electrostatic flow distribution and charging system, for the spraying of a flowable material by distribution and charging to a suitable high voltage and the spraying of the material by a multiplicity of parallel ligamental streams, wherein said system comprises:

an assembly of one or more insulated non-conductive flow distribution modules, a conductive surface with electrical connection to such surface, whereby the flowable material is electrically insulated in said system except for said conductive surface and electrical connection, means for application of an electrostatic field, one or more target bars to define the electrostatic field, and one or more catch trays, and grooves in the non-conductive flow distribution flow modules and over the conductive surface, said grooves being parallel with the electrostatic field and are distributed over the width of the flow distribution modules, whereby:

the flowable material is sprayed with minimum loss from electrical currents through said assembly, the flow of material being distributed and guided through said grooves in the non-conductive flow distribution modules and over the electrically conductive part of said assembly substantially parallel with the electrostatic field, the application of the electrostatic field providing a positive force or pressure to move the material that is sprayed, through said grooves, the flow through each groove in a flow distribution module being substantially equal or independent of specific geometry of groove or module, to hydrodynamically distribute the flowable material to be sprayed over a length of a distribution module, while the flow to each distribution module is controlled separately so that long, multiple and shaped spray assemblies can be made with a precise distribution of flow, while different flowable materials can be used in sections of the spray assembly, and wherein the target bars that define the electro static field are separate from any catch trays and shaped to create different spray patterns.

25. An electrostatic spray system installation comprising:

one or more vertical members, each having an elongate length with two outside surfaces formed along opposing sides of the length;

parallel flow distribution modules made from non conductive materials that are clamped relative to each other, the parallel flow distribution modules are positioned adjacent to the two outside surfaces of the one or more vertical members for providing parallel sprays onto a substrate formed of a non conducting material;

charging strips, each charging strip being mounted to an intermediate portion of one of the two outside surfaces of the one or more vertical members, each charging strip being oriented to face a flow distribution module and maintained at a voltage of a minimum of 20,000 volts;

sheets formed of a non conductive material, each sheet being disposed over a lower portion of one of the outside surfaces, wherein the charging strips and the sheets collectively space the flow distribution modules away from the outside surfaces of the one or more vertical members, wherein each of the flow distribution modules is supplied by a controlled flow of a flowable material, and wherein the flow distribution modules can be given different dimensions and can be positioned to give various spray configurations, and wherein the sheets extend beyond the flow distribution modules and the one or more vertical members for providing separate parallel sprays spaced 30 to 40 mm from each other; and a pair of target bars oriented parallel to the one or more vertical members for defining electrostatic fields with the charging strips;

and grooves in the non-conductive flow distribution flow modules and over the charging strips, said grooves being parallel with the electrostatic field and are distributed over the width of the flow distribution modules.

* * * * *